US008567094B2

(12) United States Patent
Lubart

(10) Patent No.: US 8,567,094 B2
(45) Date of Patent: Oct. 29, 2013

(54) SHOE CONSTRUCTION HAVING A ROCKER SHAPED BOTTOM AND INTEGRAL STABILIZER

(75) Inventor: Randy N. Lubart, Palm Beach Gardens, FL (US)

(73) Assignee: Shoes For Crews, LLC, West Palm Beach, FL (US)

( * ) Notice: Subject to any disclaimer, the term of this patent is extended or adjusted under 35 U.S.C. 154(b) by 676 days.

(21) Appl. No.: 12/703,994

(22) Filed: Feb. 11, 2010

(65) Prior Publication Data

US 2011/0067267 A1 Mar. 24, 2011

Related U.S. Application Data

(63) Continuation-in-part of application No. 12/565,383, filed on Sep. 23, 2009.

(51) Int. Cl.
*A43B 13/18* (2006.01)
*A43B 13/20* (2006.01)

(52) U.S. Cl.
USPC ..... 36/28; 36/35 B

(58) Field of Classification Search
USPC ..... 36/25 R, 28, 35 R, 31, 103, 114, 43, 88, 36/107
See application file for complete search history.

(56) References Cited

U.S. PATENT DOCUMENTS

| | | | | |
|---|---|---|---|---|
| 2,001,821 | A | | 5/1935 | Everston |
| 2,278,626 | A | | 4/1942 | Vasko |
| 3,566,487 | A | | 3/1971 | Beightol |
| 3,835,556 | A | | 9/1974 | Panaretos |
| 4,236,326 | A | | 12/1980 | Inohara |
| 4,241,523 | A | | 12/1980 | Daswick |
| 4,262,433 | A | | 4/1981 | Hagg et al. |
| 4,372,059 | A | | 2/1983 | Ambrose |
| 4,580,359 | A | * | 4/1986 | Kurrash et al. ..... 36/127 |
| 5,077,915 | A | * | 1/1992 | Gross ..... 36/31 |
| 5,138,776 | A | | 8/1992 | Levin |
| 5,179,791 | A | | 1/1993 | Lain |
| 5,224,277 | A | * | 7/1993 | Sang Do ..... 36/27 |
| 5,381,608 | A | | 1/1995 | Claveria |
| 5,579,591 | A | | 12/1996 | Kousaka et al. |
| 5,636,456 | A | | 6/1997 | Allen |
| 5,701,686 | A | | 12/1997 | Herr et al. |
| 5,782,014 | A | * | 7/1998 | Peterson ..... 36/28 |
| 6,029,374 | A | | 2/2000 | Herr et al. |
| 6,115,944 | A | | 9/2000 | Lain |
| D433,792 | S | | 11/2000 | Cockrell |

(Continued)

FOREIGN PATENT DOCUMENTS

| | | |
|---|---|---|
| EP | 2080443 | 7/2009 |
| WO | WO2005063071 | 7/2005 |

(Continued)

*Primary Examiner* — Jila M Mohandesi
(74) *Attorney, Agent, or Firm* — McHale & Slavin, P.A.

(57) ABSTRACT

A shoe construction comprising an outsole constructed from a slip resistant material and a wedge shaped cushion member having a rounded and beveled shaped lower surface bonded to the outsole. A midsole body member is bonded to the cushion member having a torsion spring member secured to the midsole body member. The torsion member assists in stabilizing the shoe construction by directing an outer surface of the outsole to a preferred position, while the lower surface is constructed and arranged to provide a curved rocker-like surface whereby the outsole remains in contact with the ground, and requires muscle control, throughout a walking step.

18 Claims, 4 Drawing Sheets

(56) References Cited

U.S. PATENT DOCUMENTS

| | | | | |
|---|---|---|---|---|
| 6,216,365 | B1 * | 4/2001 | Cohen | 36/44 |
| 6,782,639 | B1 | 8/2004 | Müller | |
| 6,915,598 | B2 | 7/2005 | Grisoni et al. | |
| 6,968,637 | B1 | 11/2005 | Johnson | |
| 7,398,608 | B2 * | 7/2008 | Schoenborn | 36/28 |
| 7,464,489 | B2 | 12/2008 | Ho | |
| 8,171,656 | B2 * | 5/2012 | Salminen et al. | 36/25 R |
| 2005/0268489 | A1 | 12/2005 | Austin | |
| 2006/0277792 | A1 * | 12/2006 | Schoenborn | 36/28 |
| 2008/0229624 | A1 | 9/2008 | Mueller | |
| 2008/0263899 | A1 | 10/2008 | Lee | |
| 2009/0300943 | A1 * | 12/2009 | Hsieh | 36/91 |

FOREIGN PATENT DOCUMENTS

| | | |
|---|---|---|
| WO | WO2006065047 | 6/2006 |
| WO | WO2008114909 | 9/2008 |
| WO | WO2009069926 | 6/2009 |

* cited by examiner

SHOE CONSTRUCTION HAVING A ROCKER SHAPED BOTTOM AND INTEGRAL STABILIZER

CROSS REFERENCE TO RELATED APPLICATIONS

This application is a continuation-in-part of U.S. patent application Ser. No. 12/565,383, filed Sep. 23, 2009, entitled "Shoe With Support System", the contents of which are incorporated herein by reference.

FIELD OF INVENTION

The invention is directed to the field of shoe construction and in particular a shoe construction having a rounded bottom with an integral stabilizer placed with the heel of the shoe to resist torsional twisting.

BACKGROUND OF THE INVENTION

Shoes with improved comfort are sought after by consumers and is a goal of shoe suppliers. Comfort is provided in three basic ways, materials of manufacture, shoe shape and cushioning. In addition to comfort, shoes worn at work sites are constructed to provide an extra margin of safety such as superior slip resistance. Slip resistance is an important feature in certain work sites such as restaurants where liquids are frequently on the floors in areas where workers walk and stand. In addition to these functional features, style can also be important particularly in areas where the public visits.

Cushioning can be provided by the insole, midsole and outsole with suitable materials of construction. Although soft soles provide comfort, they tend to be very flexible. Many of these components are made of a cellular or foam material. In addition, air cushions have been used in the heel area of the shoe particularly to reduce impact forces. The cushioning is used to reduce impact on the shoe user during use of the shoe, particularly during fast walking and running where the heel of the user first impacts the underlying surface. One problem with air cushions is that movement of entrapped air inside the cushion in one area causes other areas of the cushion to accommodate that movement, e.g., if one area is compressed, another area expands in a flexible fluid filled cushion.

Shoes that have a rounded bottom have been found to enhance safety by maintaining the shoe in contact with the ground throughout the step. For this reason the round shape has even been used for supporting of a cast used while a foot is being rehabilitated. For instance, U.S. Pat. No. 2,278,626 is a cast support having a rounded bottom, the shape maintaining the healing foot in constant contact with the ground throughout the step. In addition, the shape has a fairly narrow bottom that causes the muscles to work during the walking step by requiring muscle rehabilitation.

U.S. Pat. No. 3,566,487 discloses a cast shoe which is thicker at the center than at the heel and toe to form a curved rocker-like lower surface. A thick resilient sole covers the lower surface, and a soft flexible upper covers the arch. The inner surface of the shoe carries a layer of resilient flexible material.

U.S. Pat. No. 3,835,556 discloses a shoe base having a rigid platform wherein the ground-contacting surface of the platform extends in a continuous convex curve from the front-end to the rear-end of the platform. The convex curve includes a middle portion for location beneath the foot arch of the wearer which has a radius of curvature greater than the portions of the convex curve laying either side of the middle portion.

U.S. Pat. No. 4,372,059 discloses a shoe sole having a resiliently deformable middle segment which provides resilient, cushioned support for the arch of the wearer's foot and distributes the wearer's weight on the feet while standing, walking or running. The arch-supporting middle segment of the sole is resiliently deformable so that it pushes up against the arch of the wearer's foot when its normally convex bottom face is flattened while the wearer is standing still, and also during each step while walking or running until the foot is pivoted forward to put most of the wearer's weight on the toes and the ball of that foot. The entire shoe sole is a one-piece molded body of resiliently deformable material which is more readily deformable in the arch-supporting middle segment than in the heel-supporting rear segment and the toe-supporting front segment.

U.S. Pat. No. 4,241,523 discloses a shoe rocker member which is longitudinally curved to form a load-bearing pedestal aced beneath the base. One end of the rocker member is pivotally secured to the base and the other end is spaced from it. The space between the rocker member and the base is filled with resilient material.

U.S. Pat. No. 4,262,433 discloses a shoe having a central rocker portion formed on the bottom of the sole body substantially midway between the front end and the rear end of the sole body and connecting with said front groove with a heel formed on the rear part of the sole body. The rocker portion is arcuate convexly outwardly of the sole body on an axis perpendicular to the longitudinal axis of the sole body and extending outwardly beyond a plane connecting the outermost surface of said fore part portion and said heel whereby a roll action of the sole body is provided between the initial contact of the compressible heel and the fore part in the gait of the user.

U.S. Pat. No. 5,579,591 discloses a shoe having an upper and a sole, and a heel region having a thickness from a sole upper surface to the ground. The thickness is formed thinner at a backward portion than at a forward portion, whereby a line connecting a position on a lower surface of the sole under the head of the second metatarsus to a front end on a lower surface of the heel region of the sole is lifted at an angle with a horizontal line connecting a grounded rear end on the lower surface of the heel region to a front end thereof in a state where a weight is loaded to a human heel, and the backward portion of the heel region comprises an impact absorbing mechanism, whereby a level of the heel portion which is in contact with a foot is depressed when loaded.

U.S. Pat. No. 2,001,821 discloses the use sponge rubber, rubber coated fiber, and elastic compositions for cushioning of the foot when used in footwear.

U.S. Pat. No. 4,236,326 discloses a shoe have an upper bonded to a sole by adhesives. The shoe sole comprises a ground sole, an interlayer sole bonded at its upper surface to the shoe upper and bonded at the toe of its lower surface to the above ground sole, and an interlayer body situated at the heel portion. The shoe sole is made of rubbery material in which the ground sole at the lowermost layer consists of rigid rubber or polyurethane, and the interlayer sole and the interlayer body consists of soft rubber, polyurethane, sponge and the like.

U.S. Pat. No. 6,782,639 discloses a rounded bottom shaped shoe with a disclosure directing the shoe for use in dynamic, rolling walking action. The shoe has an upper part provided with an upper, a midsole, a midsole bottom, an undersole and a sole bottom. The sole bottom has a curved shape when unloaded that is substantially continuous and convex, without any abrupt changes in radius of curvature, along substantially the entire length thereof and includes a hard, wedge-shaped inclusion. The hard inclusions can have a random shape and size. The hard inclusions makes it possible to precorrect incorrect or abnormal postures of feet, such as in the case of skew or flat feet or abnormal postures of the knee or hip position, as well as spinal column postural deficiencies. The hard inclusions also permit massaging effects, the stimulation of foot zone reflexes and the planning of coordinated movements.

Patent Application 2008/0229624 discloses a diagonally twisted sole by inclusion of a twisted plate built into the sole.

There is thus a need for an improved shoe construction to overcome the problems attendant with the use of rounded bottoms.

SUMMARY OF THE INVENTION

The instant invention is a shoe construction having an outsole constructed from a proprietary non-slip material and design. The outsole or "skid" is topped with a wedge shaped spacer that extends from the heel through the mid foot region. The wedge shaped spacer has a rounded and beveled bottom bonded to the skid to distribute the weight of an individual along a predefined cross-section of the outsole and provide a rocker-like surface. A midsole member is constructed of a dense rubber material, having a higher durometer material than the wedge shaped spacer, is bonded to the cushion member and the outsole. The midsole member includes a torsion spring member formed from plastic or steel positioned within a receptacle, the torsion member having a U-shaped end positionable along the heel of the shoe and a shank extending from the heel to the instep. The torsion member assists in stabilizing the shoe construction by directing an outer surface of the outsole to a preferred position, while the lower surface is constructed and arranged to provide a curved rocker-like surface whereby the outsole remains in contact with the ground and requires muscle control throughout a walking step.

An objective of the invention is to enhance safety by providing a shoe that maintains ground contact at all times by use of a rounded shaped bottom.

Another objective of the invention is provide an elliptical shaped bottom that provides muscle toning by requiring progressive resistance while the shoe is worn.

Still another objective of the invention is to enhance safety by use of a torsion spring support member formed integral to the heel of the shoe wherein the torsion spring support member corrects a off angle heel impact to be corrected by forcing down an opposite side of the heel.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

Like numbers used throughout this application represent like or similar parts and/or construction.

DETAILED DESCRIPTION OF THE INVENTION

Figure 1:
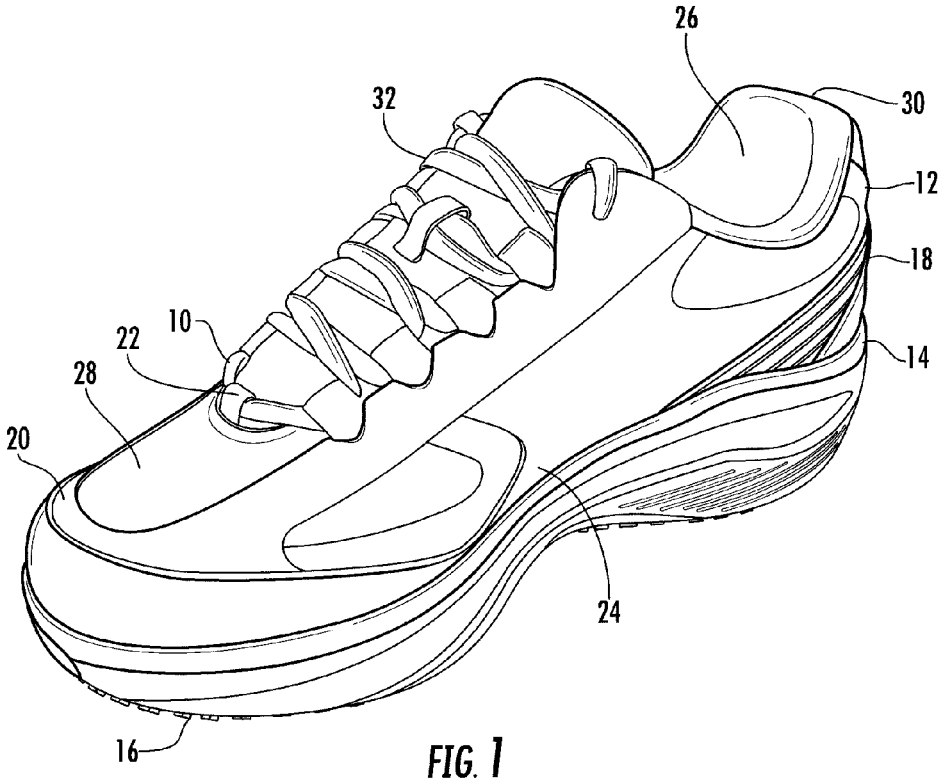
FIG. 1 is a perspective of the shoe construction.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Now referring to the Figures, set forth is an embodiment of a shoe construction 10 basically defined by an upper 12, a midsole 14, and an outsole 16. The upper 10 holds the midsole 14 and the outsole 18 to the bottom of the foot. While the style of uppers are diverse, an upper can typically be defined by the quarter 18, which is essentially the back half of the shoe and is composed of several separated pieces which when jointed together form the quarter. The vamp 20 is the front of the shoe upper and can consist of one or more pattern pieces. The throat 22 is the connecting line between the vamp and the counter where the two top pieces of the shoe are sewn together. The shank 24 is the bridge between the heel and the ball area of the shoe. The heel seat 26 is the area in the heel of the shoe where the heel of the foot rests. The toe box 28 is the cover area over the toe end of the shoe. The topline 30 is the along the rim of the shoe's quarter. The laces 32 are used to secure the upper around the foot of an individual. The materials used in construction of the upper vary with each design, the design criteria includes conformability to the foot, breath ability to prevent foot moisture containment for an hygienic construction, dimensional stability so that the upper retains it original shape even when it is conforming to the shape of the foot, and suppleness to allow the upper to be pliant while conforming to the shape of the foot.

The shoe can be further defined as having a forefoot portion 40, midfoot portion 42 and heel portion 44. The midsole member 14 is provided in overlying relation to the outsole portion. A cushion member 46 is located beneath the midsole in overlying relation to the heel portion 44 of the outsole portion 16 that extends over at least about one-half of the interior width of the heel portion of the upper.

The cushion member 46 is formed from a compressible material having a rounded and beveled shaped lower surface 48 bonded to the inner surface 50 of the midfoot 42 and heel portion 44 of the outsole 16. The cushion 46 has a substantially flat upper surface 52 and is wedge shaped having a first thickness 54 along a heel portion that is reduced to a second thickness 56 along a midfoot portion.

The cushion member 46 is positioned to underlie a portion of the midsole body 14 and overlie the heel portion of the outsole 16 to provide cushioning support for the heel area of a shoe wearer. The wedge shape begins with minimal thickness along the midsole 42 and increases to a larger thickness over the heel portion 44. The cushion member 46 is resiliently deformable to provide cushioning for a user's foot while walking. In a preferred embodiment, the cushion member is made of compressible rubber, commonly referred to as an elastomeric or polymeric foam, sponge, or open cell rubber. Alternative the cushion member can be made of a fluid or filled with gases such as air, not shown. Fluid filled cushion members are made of a polymeric material such as polyethylene, polypropylene or polyurethane capable of containing a fluid for an extended period of time of use. The cushion extends lengthwise of the heel portion and a substantial portion of the length thereof and preferably at least about one-half the length of the midsole or the complete midsole.

The midsole body 14 is formed from a dense rubber material having a bottom surface 60 bonded to the inner surface 50 of the outsole forefoot portion 40 and to the upper surface 52 of the cushion member 46. The midsole body 14 has a substantially flat top surface for receipt of an insole, not shown.

The midsole 14 may be of single or multiple piece construction and is suitably secured to the upper 12 by stitching and/or cementing. The midsole 14 can be of a molded construction and could be molded onto the upper forming a molded integral structure. The midsole 14, like the upper 12, has a forefoot portion, a midfoot portion and a hindfoot portion. The hindfoot portion contains the midsole portion and the cushion. The midsole could also be made of leather, elastomer, polymer or combinations thereof depending on the method used to assemble a shoe. In the preferred embodiment the midsole 14 is constructed from a dense rubber material that is flexible but not a soft as the cushion member 46. In the preferred embodiment, the midsole is made of a suitable material or combination of materials that preferably provide resilient cushioning and stability such as high density rubber, elastomeric or polymeric foam. The midsole 14 portion can be secured in place to the upper and outsole by stitching, cementing or encapsulation in other shoe components.

Figure 2:
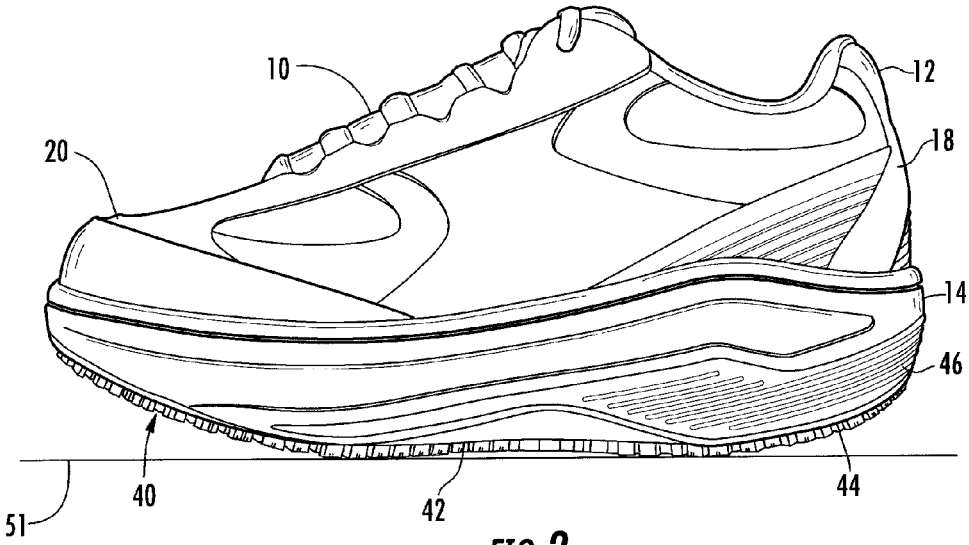
FIG. 2 is a plane side view thereof.
Figure 3:
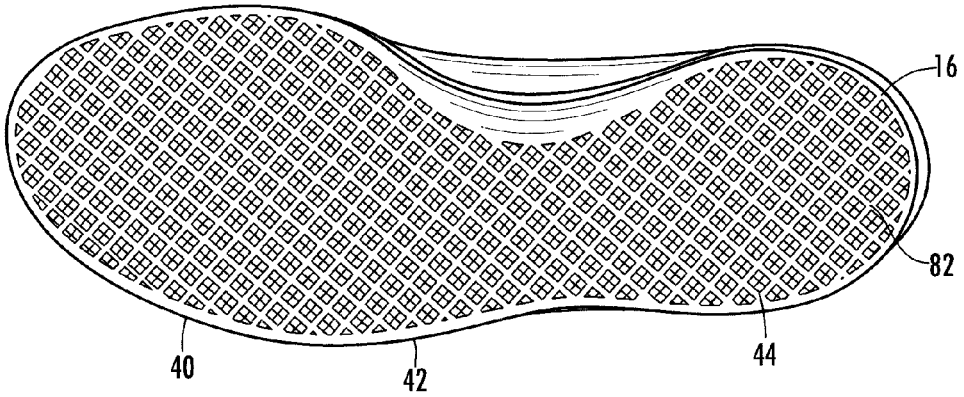
FIG. 3 is a plane bottom view thereof.
Figure 4:
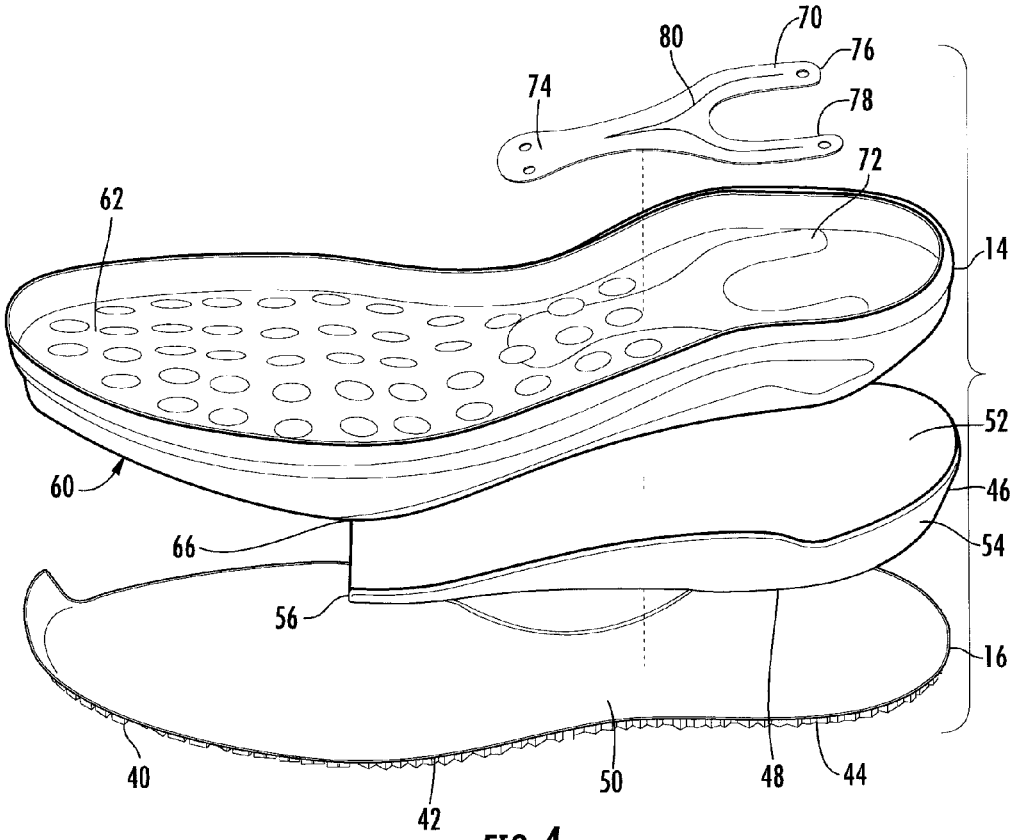
FIG. 4 is an exploded view of the shoe sole construction.

The midsole 14 overlies the front foot portion of the outsole portion and underlies the insole. The midsole can function as a heel lift to elevate the hindfoot portion of the insole. The midsole portion of the present invention provides a mounting area for a torsion spring support member 70 as described below. The midsole portion 14 operates in conjunction with the cushion member 46 and outsole 16 to create a rounded and elliptical bottom that allows the wearer to maintain contact with the ground throughout the full step. The midsole 14 can also be shaped to enhance the rocking ability of the shoe by enhancing the bevel on cushion member or by forming a bevel 66 on the bottom of the midsole on the midfoot and frontfoot portion. As best viewed in FIG. 2, the forefoot portion 42 and heel portion 44 are raised above the ground plane depicted by numeral 51, providing a continuous step while the individual is walking. A continuous step defined as the smooth transition from the heel portion to the forefoot portion in a rocker type movement. The width of the shoe construction further includes a bevel that allows traverse foot rocker movement, for which the use of the torsion spring support member 70 addresses.

The upper surface of the midsole 14 receives the torsion spring support member 70 in a receptacle 72. Preferably the torsion spring support member 70 is formed integral with the midsole. It is important that the torsion spring support member 70 must be secured to the midsole 14 to allow proper operation of the torsion spring support member in transferring of a load to the opposite side of the heel. Preferably, the support member is substantially encapsulated within the material making up the midsole and more preferably fully encapsulated with midsole material positioned above and below the torsion spring support member. This is best accomplished by molding the torsion spring support member in place. The torsion spring support member preferably covers a substantial portion of the width and length of the cushion member 46. As shown, the outer perimeter defined by an outer edge is within the outer perimeter of the cushion as defined by the outer edge of the cushion. The heel portion extends along a substantial portion of the length of the heel portion and places the forks of the member on the outside of where a heel bone would be placed. The torsion spring support member 70 includes a base portion 74 having two opposing side portions 76 & 78; each side portion is positioned along the outboard portions of the heel bone with the base portion extending into at least a portion of the midfoot area 42.

The torsion spring support member 70 is used in maintaining a shoe in an upright position by the use of load transfer. Another function of the torsion spring support member is to provide a relatively rigid foot support platform on the heel of the shoe to overlie the outsole in these areas. The support member 70 is configured to resist torsional twisting of the bottom and to resist bending or flexing of the bottom laterally across the bottom. The side portions 76 & 78 are positioned and secured in overlying relation to at least a portion of the cushion member 46.

The shaped torsion spring member 70 may be considered U-shape and includes a transverse width in the range of between about 2 inches with a depending shank that may have a length on the order of 2-3 inches depending on the shoe size and style. The torsion spring support member is shown as having a U-shaped section to help fix the position of the support member within around the heel area. The forward portion or shank of the member extends over the midfoot portion.

The torsion spring support member 70 is relatively stiff and can be made of a resiliently deformable metal alloy or tempered steel or can be a molded rigid polymer. If made of steel, the thickness of the support member 12 can be on the order of about 1/64 inch to about 3/32 inch. The width of the component parts of the support member is on the order of about 1/4 inch to about 1/2 inch.

The ribs 80 shown in the steel can be formed with a corresponding rib projecting from the surface such as by the use of steel stamping. The ribs extend into the bottom when the torsion spring support member is embedded in the midsole.

The torsion spring support member 70 provides resistance to the cushion deformation from side to side during loading of the cushion. The forward portion provides a relatively rigid platform for engagement with the forefoot portion of a foot to resist bending of the sole across the shoe and is curved to provide for a substantially normal walking gait. The heel portion limits torsional twisting or deformation of the midsole and thus the outsole about a longitudinal axis of the bottom. The torsion member 70 assists in stabilizing a shoe by directing the outer surface of the outsole to a preferred position, the lower surface constructed and arranged to provide a curved rocker-like surface whereby the outsole remains in contact with the ground and requires muscle control throughout a walking step.

The outsole 16 has an inner surface 50 and an outer surface 82. The outsole 16 is defined by a forefoot portion 42, a midfoot portion 44, and a heel portion 46. The outer surface 82 is constructed from a slip resistant material and design which may also be oil resistant. The Applicant employs a proprietary composition in its construction of the outsole and a unique design and trade dress as set forth in U.S. Design Pat. No. 433,792 assigned to the assignee of the instant invention.

It is to be understood that while certain forms of the invention are illustrated, it is not to be limited to the specific forms or arrangements herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A shoe construction comprising:

an outsole having an inner surface and an outer surface, said outsole further defined by a forefoot portion, a midfoot portion and a heel portion;

a cushion member having a lower surface bonded to said inner surface of said midfoot and said heel portion of said outsole, and an upper surface, said cushion member constructed from a first compressible material having a first durometer hardness;

a midsole body having a bottom surface bonded to the inner surface of said outsole forefoot portion and to the upper surface of said cushion member, said midsole body having a top surface, said midsole body constructed from a second compressible material, said second compressible material having a higher durometer than said first compressible material;

a torsion spring support member secured to an upper surface of said midsole body, said torsion spring support member having a U-shape with a depending shank; and a shoe upper secured to said midsole body; wherein said torsion spring support member assists in stabilizing a shoe by directing the outer surface of the outsole to a preferred position while an individual is walking.

2. The shoe of claim 1 wherein said cushion member is wedge shaped whereby said cushion member has a first thickness along a heel portion that is reduced to a second thickness along a midfoot portion.

3. The shoe of claim 1 wherein said lower surface of said cushion member is rounded wherein said lower surface is constructed and arranged to provide a curved surface to allow the outsole to remain in contact with the ground throughout a walking step.

4. The shoe of claim 3 wherein said lower surface of said cushion member is beveled wherein said lower surface is constructed and arranged to provide a curved rocker-like surface to allow the outsole to remain in contact with the ground and require muscle movement throughout the walking step.

5. The shoe of claim 4 wherein said cushion member is constructed from compressible foam rubber.

6. The shoe of claim 1 wherein said outer surface of said outsole is constructed from a slip resistant material.

7. The shoe of claim 1 wherein said midsole body is constructed of a dense rubber material.

8. The shoe of claim 1 wherein said torsion spring member has a U-shaped profile having a base portion and two opposing side portions, each side portion positioned along the outside of the heel bone with said base portion extending into at least a portion of said midfoot portion.

9. The shoe of claim 8 wherein said torsion spring support member is metal.

10. The shoe of claim 8 wherein said torsion spring support member is plastic.

11. The shoe of claim 8 wherein said torsion spring support member is embedded into the surface of said midsole body.

12. The shoe of claim 8 wherein said torsion spring support member is substantially encapsulated into said midsole body.

13. A shoe construction comprising:

an outsole having an inner surface and an outer surface, said outsole further defined by a forefoot portion, a midfoot portion and a heel portion, said outer surface constructed from a slip resistant material and design;

a cushion member formed from a first compressible material having a first durometer hardness, said cushion member having a rounded and beveled shaped lower surface bonded to said inner surface of said midfoot and said heel portion of said outsole, and a substantially flat upper surface, said cushion member is wedge shaped having a first thickness along a heel portion that is reduced to a second thickness along a midfoot portion;

a midsole body formed from a dense rubber material having a second durometer hardness that is harder than said first durometer hardness, said midsole body bottom surface bonded to the inner surface of said outsole forefoot portion and to the upper surface of said cushion member, said midsole body having a top surface;

a torsion spring member secured to an upper surface of said midsole body, said torsion member having a base portion and two opposing side portions, each side portion positioned along the outside of the heel bone with said base portion extending into at least a portion of said midfoot portion;

a shoe upper secured to said midsole body; and an insole covering said top surface of said midsole body; wherein said torsion member assists in stabilizing a shoe by directing the outer surface of the outsole to a preferred position, said lower surface constructed and arranged to provide a curved rocker-like surface whereby the outsole remains in contact with the ground and requires muscle control throughout a walking step.

14. The shoe of claim 13 wherein said cushion member is wedge shaped.

15. The shoe of claim 13 wherein said torsion spring support member is metal.

16. The shoe of claim 13 wherein said torsion spring support member is plastic.

17. The shoe of claim 13 wherein said torsion spring support member is embedded into the surface of said midsole body.

18. The shoe of claim 13 wherein said torsion spring support member is substantially encapsulated into said midsole body.

* * * * *